United States Patent [19]

Kaplan

[11] 4,265,101

[45] May 5, 1981

[54] BLOOD IDENTIFICATION MEANS

[76] Inventor: Harold Kaplan, 37 Oakland Beach Ave., Rye, N.Y. 10580

[21] Appl. No.: 941,657

[22] Filed: Sep. 11, 1978

[51] Int. Cl.[3] ..... E05B 25/00

[52] U.S. Cl. ..... 70/57; 70/163; 70/290

[58] Field of Search ..... 70/312, 163, 164, 165, 70/166, 167, 170, 171, 57, 58, 289, 290; 128/214 R, DIG. 24; 40/21 C

[56] References Cited

U.S. PATENT DOCUMENTS

| | | | |
|---|---|---|---|
| 2,661,741 | 12/1953 | Puckman | 128/DIG. 24 |
| 2,731,166 | 1/1956 | Raphael | 70/312 |
| 3,197,899 | 8/1965 | Twentier | 40/21 C |

*Primary Examiner*—Robert L. Wolfe

*Attorney, Agent, or Firm*—James P. Malone

[57] ABSTRACT

Blood identification means. A holder bag is adapted to hold a bag of blood. A coded lock is mounted in the holder bag, the lock being coded for a particular patient. A wrist band attached to the patient provides the code for the lock.

6 Claims, 8 Drawing Figures

FIG 1
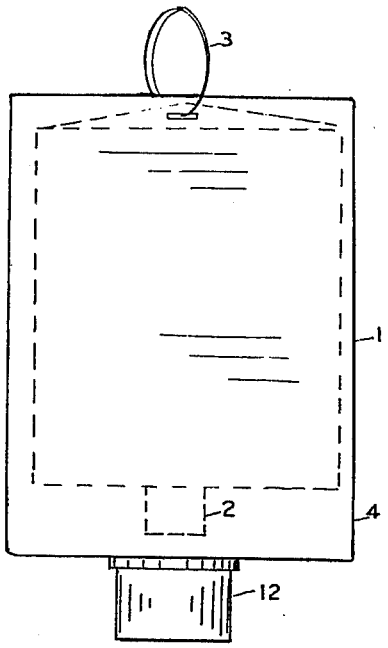
FIG 3
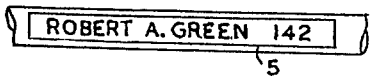
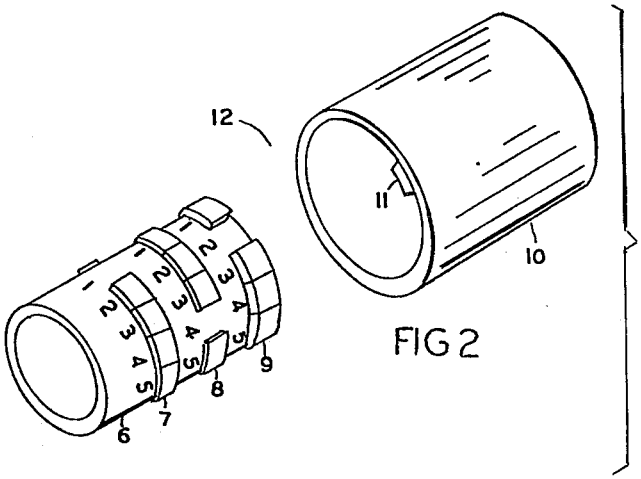
FIG 2

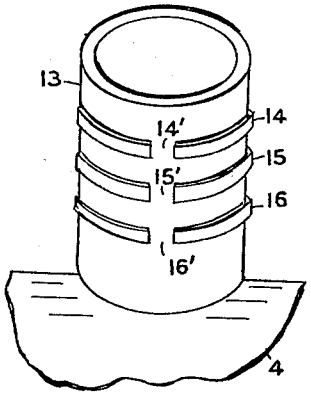
FIG 4
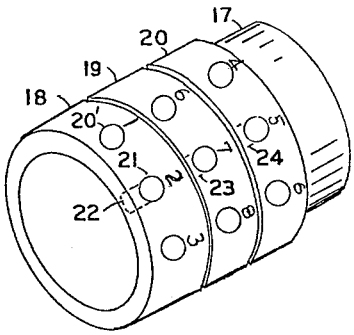
FIG 4A
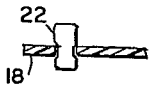
FIG 5
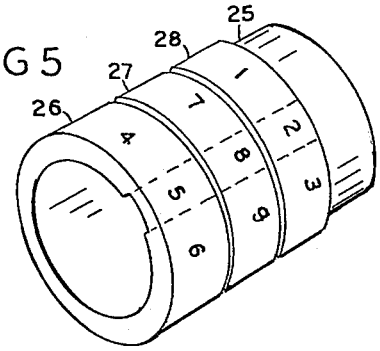
FIG 5A
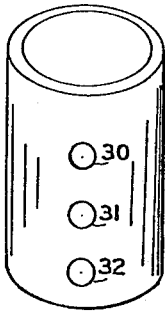
FIG 5B
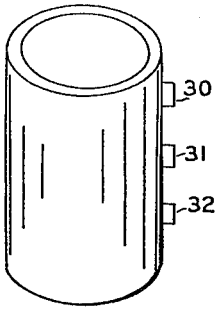

BLOOD IDENTIFICATION MEANS

This invention relates to blood identification means and more particular to means for minimizing the possibility of error when administering blood to a patient.

In virtually all hospitals, there is a Blood Bank Department which provides blood for infusion into the patients as needed. It is very important that this blood be of the proper blood type since the administration of the wrong blood type can lead to serious and possible fatal consequences.

In order to insure that the patients get the proper type blood, the patient's own blood is typed by testing, and the proper type blood is sent out from the Blood Bank to be administered to the patient. Due to the fact that the blood transfusion bag passes though a number of hands, a bag could be and sometimes is delivered and administered to the wrong patient, or the wrong type delivered.

The present invention tends to eliminate any possibility of error. The present invention provides a holder bag adapted to hold the blood bag. A coded lock is mounted in the holder bag, the lock being coded for a particular patient. The patient has a coded number on his wrist band which is attached to all patients according to standard hospital procedure. The nurse or other person who is going to administer the blood first looks at the number on the patient's wrist and then sets that number into the combination lock in order to gain acess to the blood. Therefore, once the bag of blood plasma leaves the Blood Bank there is little or no possibility of error in delivery of the proper type blood to the proper patient.

Accordingly, a principal object of the invention is to provide new and improved identification means for delivery of blood to a patient.

Another object of the invention is to provide new and improved blood idenitification means comprising, a holder bag adapted to hold a bag of blood, a coded lock mounted in the holder bag, the lock being coded for a particular patient, and means attached to the patient providing the code for the lock.

Another object of the invention is to provide new and improved blood identification means wherein a holder bag for the blood bag has a combination lock which is opened by using the code from the patient's wrist band.

These and other objects of the invention will be apparent from the following specification and drawings of which:

FIG. 1 shows a side view of an embodiment of the invention.

FIG. 2 shows a detail view of a typical combination lock for the holder bag of the invention.

FIG. 3 shows a typical wrist band with identifying blood number.

FIG. 4 is a perspective view of another embodiment of the invention.

FIG. 4A is a detail view showing the peg construction of FIG. 4.

FIGS. 5 and 5A are perspective views of another embodiment of the invention.

FIG. 5B is a side view of FIG. 5A.

Referring to the figures, FIG. 1 shows a conventional blood bag 1, which contains blood plasma. The bag has at least one neck or port 2, to which connection is made, at the patient's location, for delivery of the blood. The bag has a ring 3, on top, for hanging the bag in a vertical position.

The present invention provides a holder bag 4, which may be of transparent plastic with an aperture to accommodate the ring 3. On the lower end of the holder bag 4, opposite the port 2, is mounted a locking device 12.

The locking device 12, is preferably a combination lock which is operated by a code of at least three numbers. As shown in FIG. 3, the code number appears on the patient's wrist band 5. Therefore, in order to open the holder bag so that the delivery tube can be inserted, it is necessary for the operator to dial in the code number from the wrist band which is "142" as shown in FIG. 3.

FIG. 2 shows a typical combination locking device which is mounted on the holder bag 4. It comprises a hollow cylindrical member 6, having a plurality of rings of projecting tabs 7, 8, 9. The tabs in each ring are numbered as shown in FIG. 2. The tabs are made so that they can be individually broken away with a small clip or pliers, or even with the fingernail if necessary. This is done in the Blood Bank Department.

In order to insert the number "142", the tab "1" in the ring "7" is broken away, the tab "4" in the ring "8" is broken away, and the tab "2" in the ring "9" is broken away.

A cap 10 has an inwardly extending projection 11. The cap is designed to snap over the tabs on cylindrical member 6. Therefore, at the patient's bedside, in order to remove the cap, it is necessary to rotate the cap so that the arrow indicating the position of the projection 11 appears over the number "1" in the lowest row, then the cap can be retracted past the ring "7", the cap is then rotated to the number "4" and then retracted once more past the ring "8". The cap is then turned to the number "2" and retracted past the ring "9" and completely removed from the member 6. Thereafter, the blood delivery tubing and needle can be inserted through the hollow member 6, into the blood bag 1, and the blood administered in conventional manner.

Therefore, the present invention provides a positive identification control at the location of administering the blood. Other specific coded lock mechanisms may be used without departing from the scope of the invention as defined by the following claims.

For instance, a key operated lock may be used with the key attached to the patient's wrist band.

FIG. 4 shows another embodiment of the invention wherein the hollow member 13 is attached to the bag 4. The member 13 has three permanently affixed raised rings, 14, 15 and 16, with aligned apertures or gaps 14', 15', 16' in the rings.

The cap member 17 has mounted on it three independently rotatable rings 18, 19 and 20, each ring has equally spaced numbers "0–9" and corresponding holes 20', 21, etc., for each number. In order to set the member 17 for removal from the hollow member 13 the rings 18, 19 and 20 are moved into alignment as shown and three pegs 22, 23 and 24 are inserted. The number in this case is 37 275", the cap is slid on to the hollow member 13 and then the rings are rotated randomly. This is done at the Blood Bank.

At the patient's location it is necessary to reset the rings in accordance with the number "275" which appears on the patient's wrist. When this is done, then the cap can be removed since the pegs 22, 23, 24 will slide though the gaps 14', 15', 16' on the hollow member 13.

FIGS. 5 and 5A show another embodiment of the invention which is the mirror image of the embodiment of FIG. 4. In this case the hollow cap 25 has three rings, 26, 27 and 28. The rings are numbered from "0–9". The hollow member 29 has three projections 30, 31, 32 and in order to set the rings 26, 27 28 they are set to the patient's number which is "582" in this case, and then the rings are notched along the line defined by number "582". This notching maybe done with a round file or with a special cutting tool or jig. In the Blood Bank the cap is then placed on the hollow member 25 and rings 26, 27, 28 randomly rotated.

At the patient's location it will be necessary to set the number "582" before the cap can be removed from the hollow member 25 attached to the bag. The rings may be of plastic and may be of the type which can be snapped together for independent rotation.

It is claimed:

1. Patient blood identification and supply means to insure the correct blood supply to a patient comprising:

a holder bag adapted to hold a bag of blood for a particular patient, a coded lock mounted in the holder bag, the lock being coded for a particular patient, and means attached to the patient providing the code for the lock, whereby application of said code in cooperative viewing relation to the supply means will insure correct blood to be supplied to the patient.

2. Apparatus as in claim 1 wherein the lock is a combination lock.

3. Apparatus as in claim 2 wherein the means on the patient providing the code, is a wrist band containing the code.

4. Apparatus as in claim 3 wherein the combination lock comprises:

a hollow cylindrical member, the cylindrical member having a plurality of rings of projecting locking tabs, the tabs in each ring being numbered, the cap adapted to snap over the tabs on the hollow member, the cap having an inwardly extending projection adapted to snap over the ring tabs whereby the ring tabs may be coded by removing one tab from each ring so that once the cap is snapped on it can only be removed by rotating it sequentially to the positions of removed tabs which correspond to the code on the patient3 s wrist band.

5. Apparatus as in claim 3 wherein the combination lock comprises:

a hollow cylindrical member, the cylindrical member having a plurality of projection rings having aligned gaps, a cap adapted to fit over the rings on the hollow member the cap having a plurality of independently rotatable rings with number peg holes, whereby the code number is set by inserting pegs in the peg holes.

6. Apparatus as in claim 3 wherein the combination lock comprises:

a hollow cylindrical member having a plurality of aligned projections, a cap adapted to fit over the hollow member, the cap having a plurality of independently rotatable rings, each ring having a series of equally spaced numbers, whereby the code number is set by notching the rings.

* * * * *